United States Patent [19]

Charnitski

[11] Patent Number: 5,040,785

[45] Date of Patent: Aug. 20, 1991

[54] CLIMBING EXERCISE MACHINE

[76] Inventor: Richard D. Charnitski, 25601 Adriana St., Mission Viejo, Calif. 92691

[21] Appl. No.: 122,777

[22] Filed: Nov. 19, 1987

[51] Int. Cl.[5] ..... A63B 1/00; A63B 21/00

[52] U.S. Cl. ..... 272/70; 272/121; 128/25 R

[58] Field of Search ..... 272/70, 112, 121, 126, 272/69, 97, 71, 120; 128/25 R

[56] References Cited

U.S. PATENT DOCUMENTS

| | | | |
|---|---|---|---|
| 2,079,594 | 5/1937 | Clem . | |
| 3,363,335 | 1/1968 | Burhns et al. | 272/70 |
| 3,381,958 | 5/1968 | Gulland | 272/121 |
| 3,582,069 | 6/1971 | Flick | 272/126 |

OTHER PUBLICATIONS

"Exhibit A"—7 pages of drawings showing some structural details of the version of the Versa Climber Exercise machine discussed in the Information Disclosure Statement dated 8/17/88.

Flyer entitled "Versa Climber . . . A radically NEW approach to total fitness", published by Heart Rate, Inc., 3001 Redhill Avenue, Suite 106, Costa Mesa, Calif. 92626 (714) 850-9716.

*Primary Examiner*—Stephen R. Crow

*Attorney, Agent, or Firm*—Knobbe, Martens, Olson & Bear

[57] ABSTRACT

An improved climbing exercise machine which has hand grips and foot pedals mounted to reciprocating separate sliding trucks which move within a track structure, wherein the sliding trucks are connected to each other by chains for mechanically providing coordinated leg and arm movements that simulate a vertical climbing action in a "homolateral pattern" and a "cross crawl pattern". A change from a "homolateral pattern" to a "cross crawl pattern" is easily facilitated by a longitudinal opening provided along the center of the track structure whereby the chains linking the right handle to the right foot pedal and the left handle to the left foot pedal, respectively, are interconnected via the longitudinal opening.

12 Claims, 3 Drawing Sheets

Fig. 1
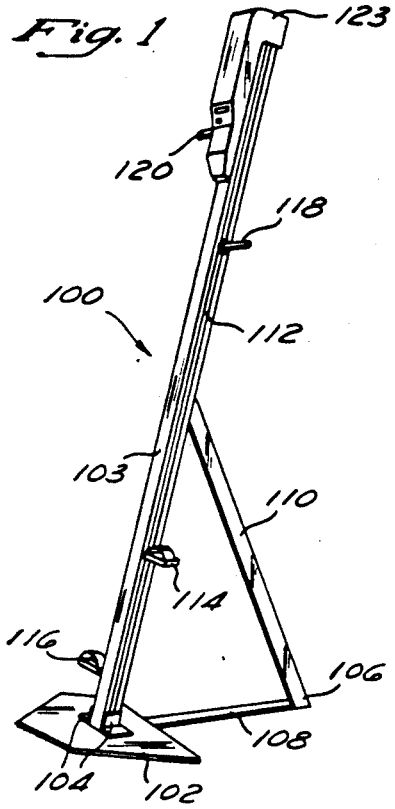
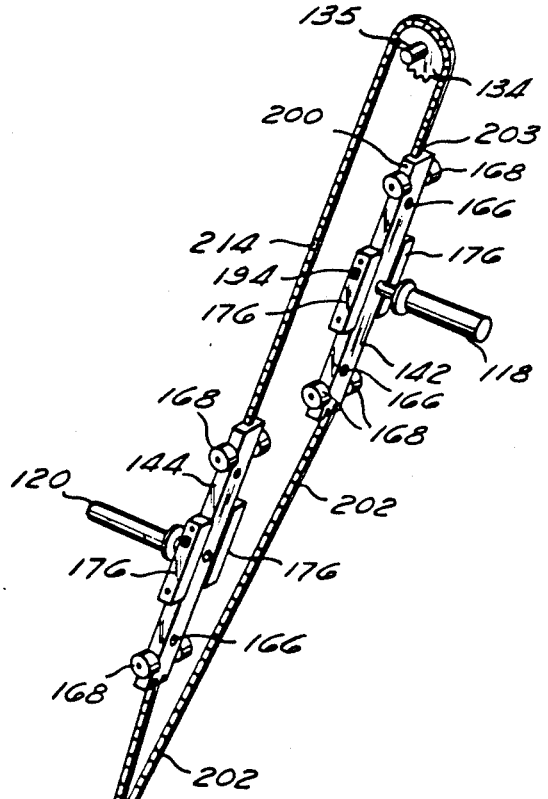
Fig. 3
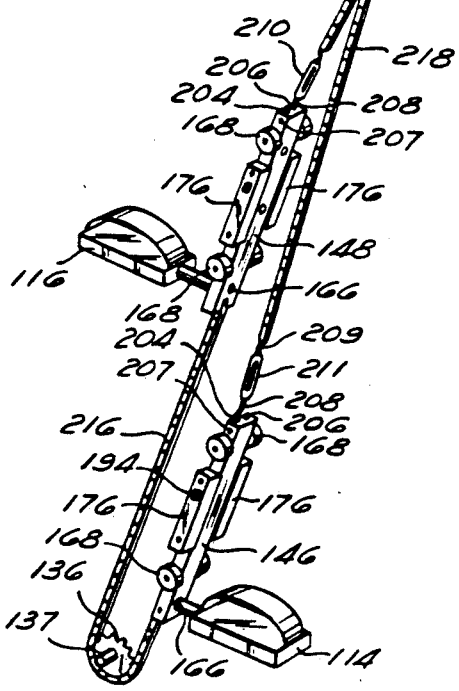
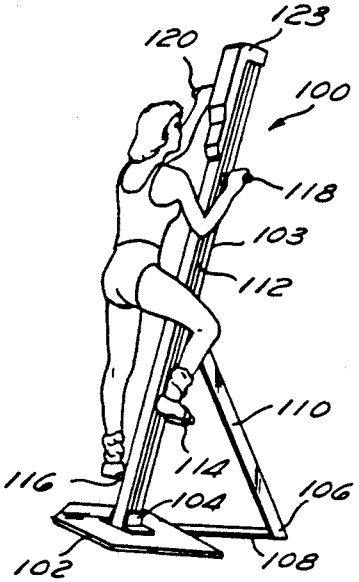
Fig. 2

135
134
103
132
128
124
112
122
126
104
130
214
154
203
198
162
200
168
152
161
166
160
150
6
184
196
194
176
118
192
142
188
170
174
201
164
199
202
190
150

CLIMBING EXERCISE MACHINE

BACKGROUND OF THE INVENTION

The present invention relates generally to the art of machine assisted exercise and more particularly to an improved climbing exercise machine for providing co-ordinated leg and arm movements to simulate a vertical climbing action.

The paramount importance of physical fitness in our society has created a continuing need for improved methods for indoor exercising involving machines specifically designed to provide varied exercising movements to enhance physical fitness. This need is partially fulfilled by the existence of various types of exercising devices such as bicycle and rowing devices that are commonly used in gymnasiums, recreation centers and rehabilitation centers. Current research has established that exercising the entire body simultaneously as opposed to in a serial fashion is considered to be the most efficient and effective approach to conditioning the body. Vertical climbing is one of the few forms of exercise that simultaneously involves all the major muscle groups of the body. Climbing, employing the use of both arms and legs, is the most complete exercise, surpassing all others such as running, cycling, rowing, swimming and cross country skiing. However not many people are willing to endure the rigors and dangers associated with the actual sport of climbing.

Some known devices for mechanically emulating a climbing motion are provided with handles and foot pedals which are adapted to move relative to one another to provide the exercising motion. Such devices generally comprise vertically extending tubular frame members which typically have two elongated reciprocating support members that are connected such that movement of one support member relative to the frame member causes movement of the other support member. A handle and a foot pedal is carried by each of the support members and extends horizontally outward from opposite sides of the frame member. Thus, when a downward force is applied to the handle and foot pedal carried by one of the support members causing it to move downward, the other support member moves upwards causing the attached handle and foot pedal to be forced upwards. Such devices implement a basic climbing motion, wherein the left arm and leg move upwardly at the same rate and the right arm and leg move downwardly at the same rate, maintaining the same distance from one another to establish a continuous rhythmic climbing motion that some people perform naturally. This particular approach to vertical climbing is referred to as the "homolateral pattern". However the same device may prove to be cumbersome for other people whose instincts naturally guide them through a climbing motion which assumes a pattern, wherein the right arm and right leg extend away from one another as the left arm and left leg contract moving towards one another and vice versa. Such an approach is referred to as the "cross crawl pattern".

Exercise devices mechanically implementing the action of vertical body climbing have taken several forms. One such device is described in U.S. Pat. No. 3,381,958 issued to Gulland and entitled "HAND AND FOOT EXERCISING DEVICE". The type of exercising device described therein provides co-ordinated leg and arm movements simulating a climbing motion wherein the right hand and right leg extend and the left hand and left leg contract associated with the "cross-crawl pattern". This type of a device has the disadvantage that the support members are placed one behind the other so that the handles and foot pedals do not move in the same plane. This makes it difficult to emulate a climbing motion in a comfortable and natural manner. Moreover, the device does not provide for homolateral climbing, and is thus particularly uncomfortable to a large portion of the population.

Another device is referred to as the "VERSA-CLIMBER" exercise machine. Such a device mechanically implements the motions of vertical, total body climbing wherein a right handle and a foot pedal are attached to and extend from the right hand side of one elongated reciprocating bar and a left handle and a foot pedal are attached to and extend from the left hand side of a second elongated reciprocating bar. The reciprocating bars are arranged for side by side reciprocating movement in a direction parallel to one another. Such an arrangement, while eliminating the problem of adjacent misalignment, since the reciprocating bars are arranged in a single plane, entails the disadvantage that the right handle and foot pedal remain the same distance apart at all times as do the left handle and foot pedal, thereby limiting its use to users comfortable with the "homolateral pattern" of simulated vertical climbing.

BRIEF DESCRIPTION OF A PREFERRED EMBODIMENT OF THE INVENTION

The present invention is directed to an improved apparatus and method for mechanically providing coordinated leg and arm movements to simulate a vertical climbing motion indoors. The improved device provides an easy and safe form of exercising, designed specifically to satisfy the needs of anyone desirous of obtaining a complete workout.

To compensate for the shortcomings and alleviate the problems associated with the existing devices the improved climbing exercise machine as disclosed in the present invention incorporates the capability of a vertical climbing motion in both the "homolateral pattern" and the "cross crawl pattern". Further this capability is provided in a climbing exercise machine which maintains the foot pedal and the handles in a single plane. The above-stated capabilities enable the machine to be used for diverse applications and considerably increases the practicality of the machine for commercial use.

The capability of providing simulation of vertical climbing in both the "homolateral pattern" as well as the "cross crawl pattern" is realized by providing a slot or opening along the center of a track structure which is formed by two side by side track members suitably attached to each other. The opening or slot along the center makes it possible for chains, which interconnect the handles and foot supports, to be crossed.

Furthermore, the reciprocating bars in the existing devices are replaced with four separate sliding trucks that are movably guided by rollers along the track members. Handles are attached to the two upper sliding trucks and foot pedals are attached to the two lower sliding trucks. The sliding trucks which support the handles are each connected by one of the interconnecting chains to one of the sliding trucks that support the foot pedals. When the device is used to implement the "homolateral pattern", the slot or opening along the center of the track structure is not utilized. Consequently, the interconnecting chains are arranged parallel to one another, with the truck supporting the right handle connected to the truck supporting the right foot support. When it is desired to implement the "cross crawl pattern", the chains are disconnected from the foot support trucks, crossed through the center opening and connected to the opposite foot support truck. The connection for the interconnecting chains is slightly offset from the center of each truck in order to allow the chains to cross without conflicting with each other.

Thus the above-stated improvements permit the construction of a "cross crawl pattern" climbing machine wherein the foot and hand supports remain in a single plane to provide for a natural, comfortable climbing motion. Further the improvements allow for a construction of a climbing machine which may be easily changed between a "homolateral pattern" and a "cross crawl pattern" simply by changing the chain connections.

BRIEF DESCRIPTION OF THE DRAWINGS

The preferred embodiment of the invention is illustrated in and by the following drawings in which like reference numerals indicate like parts and in which:

FIG. 1 is a perspective view of a climbing exercise machine in accordance with the present invention.

FIG. 2 is a perspective view of the climbing exercise machine of FIG. 1 illustrating its use in the "cross crawl pattern".

FIG. 3 is a perspective view of the chains and trucks of the climbing exercise machine of FIG. 1, broken away from the track structure and configured for use in a "cross crawl pattern".

DETAILED DESCRIPTION OF THE PREFERRED EMBODIMENT

Figures 4, 5, 6:
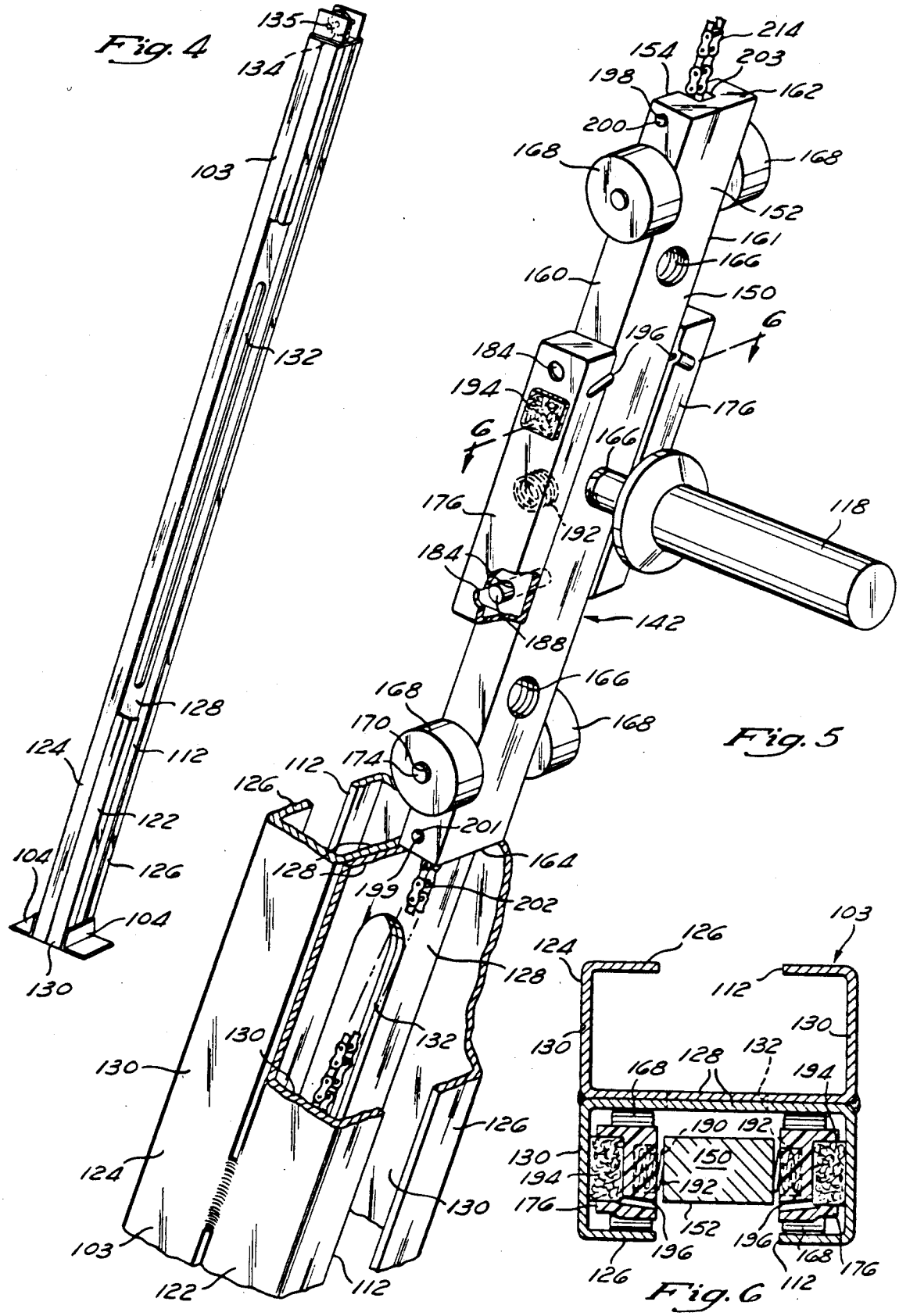
FIG. 4 is a perspective partially sectioned view illustrating the track structure of the climbing exercise machine and the opening that facilitates the "cross crawl pattern".
FIG. 5 is a fragmentary detailed section view illustrating the relationship of a sliding truck to the track structure.
FIG. 6 is a cross sectional view taken along line 6—6 of FIG. 5.

Referring now to the drawings, FIGS. 1 and 2 illustrate generally an improved climbing exercise machine 100 as disclosed in the present invention. The improved climbing exercise machine 100 comprises a bottom base member 102 which is essentially flat in shape and preferably made from a suitably rigid material such as steel. The base member 102 supports the climbing exercise machine 100 on a generally flat supporting surface such as a floor. Further, the base member 102 is of sufficient area to enable the climbing exercise machine 100 to be substantially stable when supporting the weight of an operator.

The exercise machine 100 further comprises a vertically extending track structure 103 which is attached to the base member 102 by a pair of brackets 104. The vertically extending track structure 103 is preferably constructed from rigid material such as steel in order to provide substantial support. The vertically extending track structure 103 is ensured further stability by a supporting member 106. The supporting member 106 comprises a horizontally extending section 108 and an angled section 110 which extends at a desired angle to the horizontally extending section 108. The horizontally extending section 108 is rigidly secured to the base member 102 at one end and the angled section 110 is likewise suitably secured to the track structure 103 at the other end.

The track structure 103 includes longitudinally extending slots 112 on either side. A pair of stirrup style foot pedals 114 and 116 and a pair of hand grips 118 and 120 extend through the slots 112. The two stirrup style foot pedals 114 and 116 are designated the right foot pedal 114 and the left foot pedal 116, respectively, and likewise the two hand grips 118 and 120 are designated the right hand grip 118 and the left hand grip 120, respectively. The two stirrup style foot pedals 114 and 116 are preferably arranged at the base of the track structure 103 and the two hand grips 118 and 120 are arranged approximately at chest height. The two hand grips 118 and 120 are cylindrical, padded, elongate extensions perpendicular to the track structure 103 providing a sufficient area to permit the fingers and palm of an operator's hand to establish a firm grip. The two stirrup style foot pedals 114 and 116 are relatively broader extensions also protruding perpendicular to the track structure 103. The improved climbing exercise machine 100 further comprises a housing 123, attached to the track structure, within which is included a digital display (not shown), and a hydraulic resistance adjustment (not shown) for the operating mechanism.

To use the device, the operator simply stands on the two stirrup style foot pedals 114 and 116, with the right foot on the right foot pedal 114 and the left foot on the left foot pedal 116, and grasps the two hand grips 118 and 120, with the right hand in the right hand grip 118 and the left hand in the left hand grip 120. Exercise begins for example, when the operator pulls downward on the right hand grip 118 and pushes upward on the left hand grip 120. At the same time, the operator pushes downward on the right foot pedal 114 and pulls upward on the left foot pedal 116. Such hand over hand, foot over foot climbing motion with optional variations of speed, stride and resistance is continued for the duration of time that the operator desires to exercise.

The track structure 103 is shown in FIG. 4 as comprising two identical vertically extending frame members 122 and 124. The frame members 122 and 124 are in the form of hollow rectangular tubes having a front wall 126, a back wall 128, and opposed side walls 130. The frame members 122 and 124 are adjacently aligned with the back wall 128 of each, arranged in proximity and connected by a welding. The welded back walls 128 of the frame members 122 and 124 are provided with a vertically extending longitudinal opening 132. Each of the frame members 122, 124 is also provided with a slot 112 which extends throughout the length of the front wall 126. On either end of the track structure two identical sprockets 134 and 136 are rotatably mounted on axles 135 and 137 respectively.

FIGS. 5 and 6 illustrate the feature of the invention which provides simulation of a climbing motion in a "cross-crawl pattern". A right hand sliding truck 142 which supports the right hand grip 118 is illustrated. However it should be understood that three additional trucks 144, 146 and 148, which mount the left hand grip 120, the right foot pedal 114, and the left foot pedal 116, respectively, are identical in formation and function with some minor exceptions relating to the connections for the chains, the handles and the foot pedals. These differences will be explained as they arise in this description. Thus, only the truck 142 will be described in detail. The right hand sliding truck 142 comprises an elongate rectangular body portion 150 extending in a vertical direction. The body 150 is preferably made from a rigid metallic material such as steel, and comprises a right hand wall 152, a left hand wall 154, a front side wall 160, a rear side wall 161, as well as a top end wall 162 and a bottom end wall 164. The elongate rectangular body portion 150 includes three identical circular apertures 166 centered on the longitudinal axis of the front wall 152 and positioned at spaced locations along the length of the body portion 150. The three circular apertures 166 extend completely through the body portion 150 and have a threaded interior whereby any one of the three apertures 166 may receive and rigidly engage the right hand grip 118. This enables the right hand grip 118 to withstand the pressure applied by the operator. The above described set of three apertures 166 are included in the trucks 142 and 144 to provide an optional variation whereby the distance of the hand grips 118 and 120, respectively, relative to the foot pedals 114 and 116, respectively may be suitably adjusted as desired by the operator. Unlike the trucks 142 and 144 for the handles the foot pedal trucks 146 and 148 each have only one circular threaded aperture 166 for connecting the respective foot pedals 114, 116.

Four identical cylindrical guidance rollers 168 are arranged in pairs adjacent the sides 160 of the elongate rectangular body portion 150. Two of the rollers 168 are positioned adjacent one end 162 of the rectangular body portion 150 and the other two rollers 168 are positioned adjacent the other end 164. Each of the guidance rollers 168 have a central aperture 170 which is horizontally aligned with a similar aperture (not shown) provided at both ends of the body portion 150. An axle 174 is rigidly attached within the aperture in the body portion 150 and extends to rotatably mount the rollers 168. The rollers 168 thus act as wheels which roll within one of the frame members 122, 124 of the track structure 103. When so positioned, the apertures 166 are aligned with the slot 112 in the front wall 126 of the frame member 122 so that the handle 118 connected to the aperture 166 may extend beyond the track structure 103.

Placed adjacently relative to the side walls 160 of the elongate rectangular body portion 150 are two identical centering blocks 176. The centering blocks 176 are preferably made from a tough plastic such as molysulfide impregnated nylon and include an identical pair of circular alignment apertures 184. Each aperture 184 partially receives a cylindrical alignment pin 188 which extends from the body portion 150. The centering blocks are free to reciprocate along the pins 188. Within a cavity 190 provided within each of the centering blocks 176 is placed a spring 192. The centering blocks 176 are further provided with a substantially square pad 194 which is preferably made from relatively absorbent material such as felt. In addition, towards the upper end of each of the centering blocks 176 are provided two slightly tilted conduits 196. These conduits 196 allow lubricants to be administered at the upper, open end of the conduits 196, which lubricants flow into the felt pads 194. The open ends of the conduits 196 are accessible through the slots 112 to permit lubrication without disassembling the device. The centering blocks 176 are sized to fit within the frame member 104 in a close fitting, sliding relationship. Adjacent the top 162 and bottom 164 ends, the body 150 is provided with small circular apertures 198, 199, respectively which are horizontally aligned relative to each other. Through each of the apertures 198 is received a cylindrical pin 200, 201 respectively. The pins 200, 201 provide means for linking the right hand sliding truck 142 with chains 202 and 214.

Spring 192 acts to urge the centering blocks 176 out away from the body portion 150 and into contact with the side walls 130 of the track structure 103. The friction generated by the contact between the centering blocks 176 and the side walls 130 results in some resistance to movement of the trucks 142, 144, 146, 148. The strength of the spring can be varied resulting in different levels of resistance for different users. In particular it has been found that by providing a force of about 12.4 lbs outwardly at each spring, a desirable level of resistance is created. This can be advantageously accomplished by providing a spring having a 0.75 inch uncompressed length with a spring constant of about 33 lbs/inch and mounting the spring such that it is compressed to a length of about 0.375 inches.

In another preferred form the springs are not included at all and an adjustable resistance is provided by connecting the axle 135 of the upper sprocket 134 to a hydraulic pump (not shown) which is set up to pump fluid in both directions through an adjustable orifice. In another preferred form both the springs and the adjustable hydraulic resistance are provided.

In operation the right hand truck 142 maintains a close sliding relationship with the frame member 104. The four rollers 168 of the right hand truck 142 roll along the front wall 126 and the back wall 128 of the frame member 122, so that the truck 142 slides up and down the frame member 122 with considerable ease. The close sliding relationship between the frame member 122 and the truck 142 is additionally facilitated by the arrangement of the centering blocks 176. These centering blocks 176 prevent the body portion 150 from coming into contact with the opposed side walls 130 of the frame member 122, to assist in the relatively unobstructed movement along the frame member 122.

Figure 8:
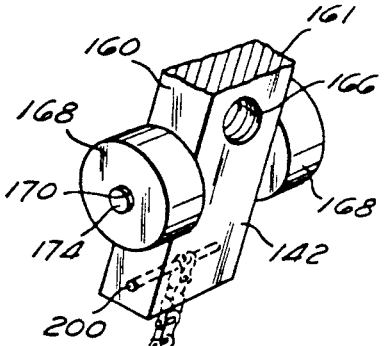
FIG. 8 is an enlarged perspective view of the connection between the chains and trucks.
Figure 8:
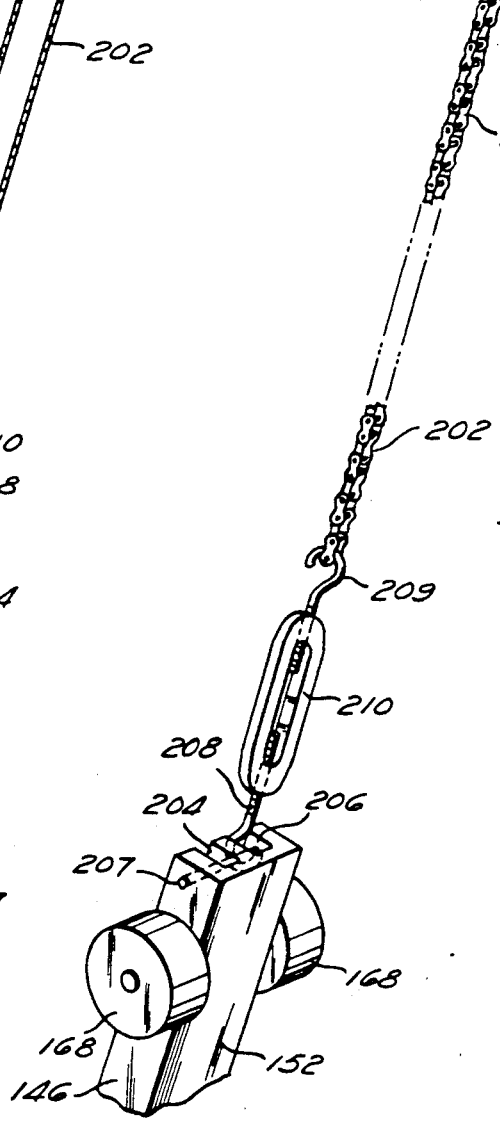
Figure 9:
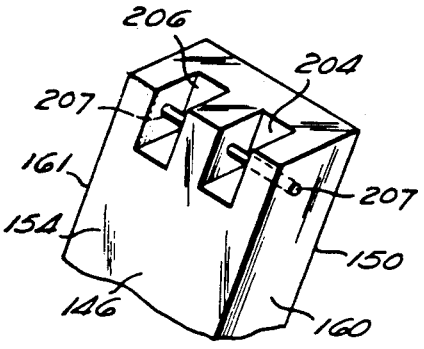
FIG. 9 is a fragmentary enlarged perspective view of the end of a truck which connects to the chains.

FIGS. 8 and 9 illustrate the interconnection between the chain 202, the right hand truck 142 and the right foot truck 146. Such an arrangement is also representative of the interconnection of chain 218 between the left hand truck 144 and the left foot truck 148. FIG. 9 shows a detail of the upper portion of the right foot truck 146. This portion is identical to the upper portion of the left foot truck 148. As shown in FIG. 9 the upper portion of each of the foot trucks 146,148 has two slots 204 and 206 which are offset from one another and equally spaced from the center of the upper end of the truck 146. The lower end of the right hand truck 142 is provided with a single slot like slot 206 shown in FIG. 9, which is offset from the center towards the rear side wall 161 of the truck 142. Likewise the lower end of the left hand truck 144 is provided with a single slot, like slot 204 which is offset from the center of the truck 144 towards the front side wall 160.

As described above, the right foot truck 146 is provided with two identically sized slots 204 and 206 which are placed proximate to each other. The slots 204 and 206 face the left hand wall 154 of the body portion 150 of the right foot truck 146. Furthermore, the slots 204 and 206 are located at positions offset from the center towards the front side wall 160 and the rear side wall 161, respectively. The slot in the right hand truck 142 is offset to towards the rear side wall 161 and is aligned with slot 206 of the right and left foot trucks 146 and 148, respectively. The slot in the left hand truck 144 is offset toward the front side wall and is aligned with the slot 204 of the left and right foot trucks 146 and 148, respectively.

A pin 207, like pin 201 is provided which passes through the upper portion of the foot truck 146. The pin 207 may advantageously be affixed to the body portion 150 by welding, for example. The pin 207 is arranged such that it passes through the center of the slots 204 and 206. A similar arrangement is found at the upper end of the left foot truck 148.

Truck interconnecting chains 202 and 218 are advantageously ordinary chains of the type used in the drive train of a motorcycle or bicycle. As indicated previously the lower end of each of the hand trucks 142 and 144 has a pin 200 inserted through the front side wall 160 to the rear side wall 161. The pin is arranged such that it passes through the central portion of the offset slots. The upper end of the chain 202 is connected in a well known manner directly to the pin 200 within the slot in the lower end of the right hand truck 142. Likewise, chain 218 is connected at its upper end to the pin 200 within the slot in the lower end of the left hand truck 144.

Chains 202 and 218 are connected, at their lower ends to turnbuckles 210 and 211 respectively. The turnbuckle 210 has two hooks 208 and 209, arranged on the opposite ends thereof. In operation hook 209 is hooked to the lower end of chain 202, advantageously through the last link thereof. When it is desired to provide a "homolateral pattern", hook 208 of the turnbuckle 210 is connected to the right foot sliding truck 146 by engaging hook 208 of turnbuckle 210 with pin 207 in the slot 206 adjacent the rear side wall 161 of foot truck 146. Likewise turnbuckle 211 is connected to the end of chain 218 and to pin 207 in slot 204 adjacent the front side wall 160 of the left foot truck 148.

The turnbuckles 210, 211 are provided at the end of the chains 202 and 218 to enable the manufacturer to adjust the tension in the overall system. Also in order to connect the chains initially it is necessary to release and unscrew the turnbuckles as far as they will go so that there is sufficient slack in the chain to allow the hooks 208 of the turnbuckles 210, 211, to be properly connected to the pins 207 in the proper slots. After the connections are made the turnbuckles are tightened by simply turning the "buckles" in the direction which causes the hooks 208, 209 to be drawn closer together. The slots 112 on both sides of the track structure each have a width of sightly more than an inch permitting the user to insert a hand into the track and turn the buckle of the turnbuckle to adjust the tension. Also as will be described below this permits the user to change the connection points of the lower ends of the chain between the foot trucks 146 and 148 to change the pattern of the machine from a "homolateral pattern" to a "cross crawl pattern" and vice versa. The two adjacent slots 204 and 206 have been offset from each other to allow the chains 202 and 218 to cross through opening 132 without interfering with each other in the implementation of the "cross crawl pattern".

FIG. 3 illustrates the arrangement of the right hand truck 142, the right foot truck 146, the left hand truck 144 and the left foot truck 148 in relation with each other in an implementation of the "cross crawl pattern". The two sprockets 134 and 136 are arranged at opposite ends so that a chain 214 may be fed over the sprocket 134 to provide connecting means between the right hand truck 142 and the left hand truck 144. The connection is made in a slot 203 located in the center of the upper end of body 150 of the hand truck 142. A pin 201 extends through the slot. One end of the chain 214 is directly connected to the pin 201 in slot 203 and the other end is directly connected to a similar pin/slot construction on the upper end of the hand truck 144. Likewise a chain 216 is fed over the sprocket 136 providing connecting means between the right foot truck 146 and the left foot truck 148. The connection between the lower portion of each of the foot trucks and chain 216 is made in exactly the same way as described in connection with chain 214, slot 203 and pin 201.

As shown in FIG. 3 the lower portion of the right hand truck 142 is linked to the left foot truck by connecting the hook 208 of the turnbuckle 210 on chain 202 to pin 207 within the slot 206 adjacent the rear wall of the left foot truck 148. Furthermore, the left hand truck 144 is connected to the right foot truck 146 by connecting the hook 208 of turnbuckle 211 on chain 218 to pin 207 within the slot 204 adjacent the front wall of the right foot truck. Such an interconnection of the chains is facilitated by the provision of the vertically extending longitudinal opening 132 which makes it possible to provide the implementation of a climbing motion in a "cross crawl pattern".

Figure 7:
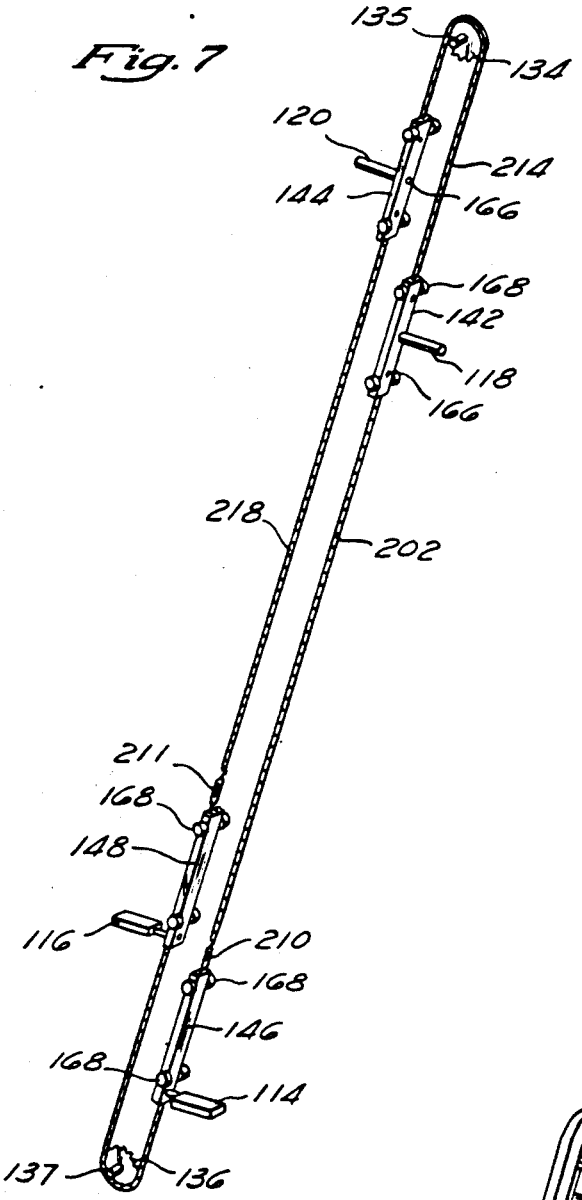
FIG. 7 is a perspective view of the chains and trucks of the climbing exercise machine broken away from the track structure, and configured for use in a "homolateral pattern".

FIG. 7 illustrates the arrangement of the right hand truck 142, the left hand truck 144, the right foot truck 146 and the left foot truck 148 in relation with each other in an implementation of simulated vertical climbing in a "homolateral pattern". In such an arrangement the chain 218 connects the left hand truck 144 with the left foot truck 148 and the chain 202 connects the right hand truck 142 with the right foot truck 146.

The method of changing the machine from a "homolateral pattern" shown, in FIG. 7, to a "cross crawl pattern" shown, in FIG. 3, is fairly uncomplicated and may be carried out in a relatively short duration of time. This is accomplished by first turning the turnbuckles 211 and/or 210 as necessary to release the tension on the system. Then a user disengages the hook 208 attached via the turnbuckle 211 to the chain 218 from the left foot truck 148. After turning the turnbuckles 211 and/or 210 as necessary to release the tension in the chain 218, it is possible to easily detach the hook 208 accessing the interior of the track through slots 112 and opening 132. Following this, the turnbuckle 211 and the lower end of chain 218 are then passed through the longitudinal opening 132, and the hook 208 is engaged to the right foot truck 148 in the slot 204 adjacent the front wall 160 of the right foot truck 146. Next the hook 208 of the turnbuckle 210 attached to the chain 202, is disengaged from slot 206 adjacent the rear wall 161 of the truck 148. The turnbuckle 210 along with the lower end of chain 202 is then passed through opening 132. The hook 208 of the turnbuckle 210 is then connected to the pin 207 in the slot 206 adjacent the rear wall of the left foot truck 148. Note that the chain 202 is not disengaged from the right foot truck 146 until after chain 218 is connected thereto. Thus only the left foot truck will be left unconnected for any length of time. That is until the chain 202 can be disconnected and then reconnected to the left foot truck 148. During this period when the truck 148 is disconnected it can be held in place manually. In order to change the machine back to a "homolateral pattern" the above process is simply reversed.

What is claimed is:

1. A climbing exercise machine to provide simulation of a vertical climbing motion by enabling coordinated leg and arm movement, said climbing exercise machine comprising:

a base member;

a right track and a left track, said right and left track arranged substantially parallel to one another in side by side relationship, said right and left tracks attached to said base member such that one end of each of said tracks is at a higher elevation than the other and;

first and second trucks, said first and second trucks mounted on the right track for movement along the right track with said first truck mounted above said second truck;

third and fourth trucks, said third and fourth trucks mounted on the left track for movement along the left track with said third truck mounted above said fourth truck; wherein said first truck has a first handle and said third truck has a second handle extending therefrom and said second truck has a first foot support and said fourth truck has a second foot support extending therefrom, each of said first and second handles and each of said first and second foot supports mounted such that their movement is within a single plane;

each track having at least one bearing surface which supports said trucks, said bearing surface substantially parallel and opposed to each other, said surface bearing at least a portion of the load applied by the user to the exercise machine, said handles and said foot supports extending outwardly from their respective tracks in a direction generally opposite to the bearing surface in their respective tracks;

an opening between said tracks intermediate the ends thereof to permit the interconnection of said trucks; and interconnecting elements interconnecting each of said first, second, third and fourth trucks to provide a "cross crawl pattern" climbing motion whereby movement of the hands and feet of the user remain in a single plane throughout the entire range of displacement of said trucks.

2. A climbing exercise machine as defined in claim 1, wherein the interconnecting elements include means for changing the interconnections to permit the machine to operate in a "homolateral pattern".

3. A climbing exercise machine as defined in claim 2, wherein said "homolateral pattern" is implemented when said first handle and said first support maintain a uniform distance apart from each other and said second handle and said second foot support also maintain a uniform distance apart from each other.

4. A climbing exercise machine as defined in claim 1, wherein said "cross crawl pattern" is implemented when said first handle and said first support extend away from each other while said second handle and said second foot support contract towards each other.

5. A climbing exercise machine as defined in claim 1, wherein said track structure forming two parallel, side by side tracks, comprises two bars, said bars having a front wall, a back wall and two opposed side walls, wherein said back walls of each of said bars are fixed together.

6. A climbing exercise machine as defined in claim 5, wherein said opening permitting interconnection of said trucks comprises a longitudinal opening along the length of said fixed back wall of said tracks.

7. A climbing exercise machine as defined in claim 6, wherein said "cross crawl pattern" is implemented when said first truck is connected to said fourth truck by one of said interconnecting elements passing through said longitudinal opening and said second truck is connected to said third truck by another of said interconnecting elements passing through said longitudinal opening.

8. A method of changing from a "homolateral pattern" to a "cross crawl pattern" of simulated vertical climbing in a climbing exercise machine, said climbing exercise machine comprising:

a track structure having right and left tracks mounted parallel to one another, said right and left tracks having a longitudinal opening between them; and a first and a second truck, said first truck mounted above said second truck for movement along the right track; and a third and a fourth truck, said third truck mounted above said fourth truck for movement along the left track; and said first and third trucks having handles extending therefrom and said second and fourth trucks having foot supports extending therefrom, first and second interconnecting means, each of said first and second interconnecting means having a first and second end, wherein said first end of said first interconnecting means connects to said first truck and said second end of said first interconnecting means connects to said second truck, and said first end of said second interconnecting means connects to said third truck and said second end of said second interconnecting means connects to said fourth truck; and said method of changing from a "homolateral pattern" to a "cross crawl pattern" comprising the steps of:

disengaging the second end of said first interconnecting means from said second truck;

connecting said second end of said first interconnecting means with said fourth truck;

disengaging the second end of said second interconnecting means from said fourth truck; and connecting said second end of said second interconnecting means with said second truck.

9. The method of claim 8 wherein the step of disengaging the second end of said first interconnecting means from said second truck further includes releasing the tension in the system and passing the second interconnecting means through said longitudinal opening.

10. The method of claim 9 wherein the step of disengaging the second end of said second interconnecting means from the fourth truck includes releasing the tension of the system and passing the first interconnecting means through said longitudinal opening.

11. A method of operating a climbing exercise machine in two climbing patterns, said climbing exercise machine comprising;

a base member;

a right track and a left track, said right and left tracks arranged substantially parallel to one another in side by side relationship, said right and left tracks attached to said base member such that one end of each of said tracks is at a higher elevation than the other and;

first and second trucks, said first and second trucks mounted on the right track for movement along the right track with said first truck mounted above said second truck;

third and fourth trucks, said third and fourth trucks mounted on the left track for sliding movement along the left track with said third truck mounted above said fourth truck; and an opening between said tracks intermediate the ends thereof to permit the interconnection of said trucks;

said method of operating comprising the steps of;

connecting the first truck to the second truck and the third truck to the fourth truck to provide a "homolateral pattern" of climbing;

disconnecting the connection between the first and second trucks and the third and fourth trucks;

connecting through said opening the first truck to the fourth truck and the second truck to the third truck to provide a "cross crawl pattern" of climbing.

12. A climbing exercise machine to provide simulation of a vertical climbing motion by enabling coordinated leg and arm movements, said climbing exercise machine comprising:

a base member;

a right track and a left track, said right and left tracks arranged substantially parallel to one another in side by side relationship, said right and left tracks attached to said base member such that one end of each said tracks is at a higher elevation than the other end;

first and second trucks, said first and second trucks mounted on the right track for movement along the right track with said first truck mounted above said second truck;

third and fourth trucks, said third and fourth trucks mounted on the left track for movement along the left track with said third truck mounted above said fourth truck; wherein said first truck has a first handle and said third truck has a second handle extending therefrom and said second truck has a first foot support and said fourth truck has a second foot support extending therefrom;

an opening between said tracks intermediate the ends thereof to permit the interconnection of said tracks; and flexible interconnecting means interconnecting each of said first, second, third and fourth trucks, said interconnecting elements being selectively disengageable and reattachable in two different configurations to selectively provide for a "cross crawl pattern" climbing motion in one configuration and a "homolateral" climbing motion in another configuration.

* * * * *